US010731621B2

(12) United States Patent
Fiveland

(10) Patent No.: US 10,731,621 B2
(45) Date of Patent: Aug. 4, 2020

(54) IGNITION SYSTEM HAVING COMBUSTION INITIATION DETECTION

(71) Applicant: Caterpillar Inc., Peoria, IL (US)

(72) Inventor: Scott B. Fiveland, Metamora, IL (US)

(73) Assignee: Caterpillar Inc., Peoria, IL (US)

( * ) Notice: Subject to any disclaimer, the term of this patent is extended or adjusted under 35 U.S.C. 154(b) by 553 days.

(21) Appl. No.: 15/386,793

(22) Filed: Dec. 21, 2016

(65) Prior Publication Data

US 2018/0171962 A1 Jun. 21, 2018

(51) Int. Cl.

| | |
|---|---|
| ***F02P 17/12*** | (2006.01) |
| ***F02P 9/00*** | (2006.01) |
| *F02B 77/08* | (2006.01) |
| *F02P 5/15* | (2006.01) |
| *F02P 5/153* | (2006.01) |
| *F02P 15/08* | (2006.01) |

(52) U.S. Cl.

CPC ..... *F02P 17/12* (2013.01); *F02P 9/002* (2013.01); *F02B 77/085* (2013.01); *F02P 5/1502* (2013.01); *F02P 5/153* (2013.01); *F02P 15/08* (2013.01); *F02P 2017/121* (2013.01)

(58) Field of Classification Search

CPC .. F02P 17/12; F02P 9/002; F02P 5/153; F02P 15/08; F02P 2017/121; F02P 5/1502; F02B 77/085

See application file for complete search history.

(56) References Cited

U.S. PATENT DOCUMENTS 4,710,881 A * 12/1987 Mouri ..... F02P 5/1521 123/406.36
4,829,962 A * 5/1989 Hafner ..... F02P 5/152 123/406.33
5,035,219 A * 7/1991 Ohkumo ..... F02P 5/1506 123/406.33
5,237,504 A * 8/1993 Holmes ..... G01M 15/11 701/102
5,333,593 A * 8/1994 Morganti ..... F02P 3/02 123/637
5,979,406 A * 11/1999 Aoki ..... F02P 5/1525 123/406.33
6,283,103 B1 * 9/2001 Hoeflich ..... F02P 3/0869 123/596
8,078,384 B2 12/2011 Glugla et al.
8,662,059 B2 3/2014 Gschirr (Continued)

FOREIGN PATENT DOCUMENTS

WO WO 2011/023852 A1 3/2011
WO WO 2015/071245 A1 5/2015

*Primary Examiner* — Sizo B Vilakazi

(74) *Attorney, Agent, or Firm* — Hibshman Claim Construction PLLC

(57) ABSTRACT

An ignition system for an engine is disclosed. The ignition system may have an igniter connected to selectively ignite a fuel mixture within the engine, at least one sensor configured to sense operation information of the engine and generate corresponding signals, and a controller in communication with the igniter and the at least one sensor. The controller may be configured to cause a first striking of the igniter to ignite the fuel mixture, make a determination that the fuel mixture has been ignited by the igniter based on the signals, and selectively cease striking of the igniter based on the determination.

17 Claims, 2 Drawing Sheets

(56) References Cited

U.S. PATENT DOCUMENTS

| | | | | |
|---|---|---|---|---|
| 2011/0144881 | A1* | 6/2011 | Glugla | F02P 15/08 701/102 |
| 2011/0270506 | A1 | 11/2011 | Maier et al. | |
| 2012/0247441 | A1 | 10/2012 | Schultz | |
| 2014/0076274 | A1 | 3/2014 | Tozzi et al. | |
| 2015/0152804 | A1* | 6/2015 | Sakayanagi | F02D 41/2416 701/115 |
| 2015/0211474 | A1* | 7/2015 | Eckardt | F02P 5/04 123/637 |
| 2017/0226956 | A1* | 8/2017 | Suzuki | F02D 35/023 |

* cited by examiner

IGNITION SYSTEM HAVING COMBUSTION INITIATION DETECTION

TECHNICAL FIELD

The present disclosure relates generally to an ignition system and, more particularly, to an ignition system having combustion initiation detection.

BACKGROUND

Engines, including diesel engines, gasoline engines, gaseous fuel powered engines, and other engines known in the art ignite an air/fuel mixture to produce heat. In one example, fuel injected into a combustion chamber of the engine is ignited by way of a spark plug. Specifically, a high voltage current is directed through an electrode located at a center of the spark plug, from a terminal end to a distal free end. The distal free end is spaced a particular distance from a grounded portion of the spark plug, such that an arc spanning the distance is generated. This arc has sufficient voltage to breakdown and thereby ignite an air and fuel mixture within the combustion chamber.

Although successful at initiating combustion, a spark plug may suffer from a low component life. The spark plug life typically depends on an amount and/or a duration of energy delivered to the spark-plug. For example, the high breakdown voltage requirement of the spark plug's arc can be damaging to the grounded portion of the spark plug. In addition, during a conventional ignition process, the spark plug is usually supplied with energy for a long fixed duration, regardless of whether combustion has already been initiated. That is, the spark plug is struck over and over again (i.e., supplied with a current following a repeating profile) regardless of combustion initiation until the fixed time duration has relapsed. Therefore, in situations where combustion has already been initiated, extra and unnecessary strikes of the spark plug not only waste energy but also detrimentally affect the spark plug life. This may lead to reliability reduction of the spark plug and/or premature replacement of the spark plug to ensure continued operation of the engine.

One attempt at extending the life of a spark plug is described in U.S. Pat. No. 8,078,384 (the '384 patent) that is issued to Glugla et al. on Dec. 13, 2011. The '384 patent discloses systems and methods for controlling an internal combustion engine including determining a presence of charge dilution and selecting a spark restrike mode to provide multiple spark events during a single combustion cycle. Charge dilution is determined based on a commanded air/fuel ratio and exhaust gas recirculation. Multiple spark events are controlled using time-based restrike or current-based restrike in response to the charge dilution, thus improving ignition quality to facilitate extending the spark plug life.

Although the system and method of the '384 patent may improve ignition quality of the spark plug, it may still be sub-optimal. For example, extra and unnecessary strikes may still be performed after combustion has been initiated. This may cause premature wear of the spark plug and cause the spark plug to operate unreliably.

The disclosed ignition control system is directed to overcoming one or more of the problems set forth above.

SUMMARY

In one aspect, the present disclosure is directed to an ignition system for an engine. The ignition system may include an igniter connected to selectively ignite a fuel mixture within the engine, at least one sensor configured to sense operation information of the engine and generate corresponding signals, and a controller in communication with the igniter and the at least one sensor. The controller may be configured to cause a first striking of the igniter to ignite the fuel mixture, to make a determination that the fuel mixture has been ignited by the igniter based on the signals, and to selectively cease striking of the igniter based on the determination.

In another aspect, the present disclosure is directed to a method of initiating combustion within an engine. The method may include initiating a first striking of an igniter to ignite a fuel mixture within the engine, detecting combustion initiation of the fuel mixture, and selectively ceasing striking of the igniter based on detection of the combustion initiation.

In yet another aspect, the present disclosure is directed to an engine. The engine may include an engine block at least partially defining a cylinder, a piston reciprocatingly disposed within the cylinder to form a combustion chamber, an igniter located to locally heat a fuel mixture within the combustion chamber, at least one senor configured to sense operational information of the engine and generate corresponding signals, and a controller in communication with the igniter and the at least one sensor. The controller may be configured to cause a first striking of the igniter to ignite the fuel mixture, to make a determination that the fuel mixture has been ignited by the igniter based on signals, and to selectively cease striking the igniter based on the determination. The controller may include a striking profile library stored in a memory, and the first striking may be determined based on a first striking profile retrieved from the striking profile library. The controller may be further configured to retrieve a second striking profile from the striking profile library and strike the igniter using the second striking profile after a specified number of strikings using the first striking profile fails to ignite the fuel mixture.

DETAILED DESCRIPTION

Figure 1:
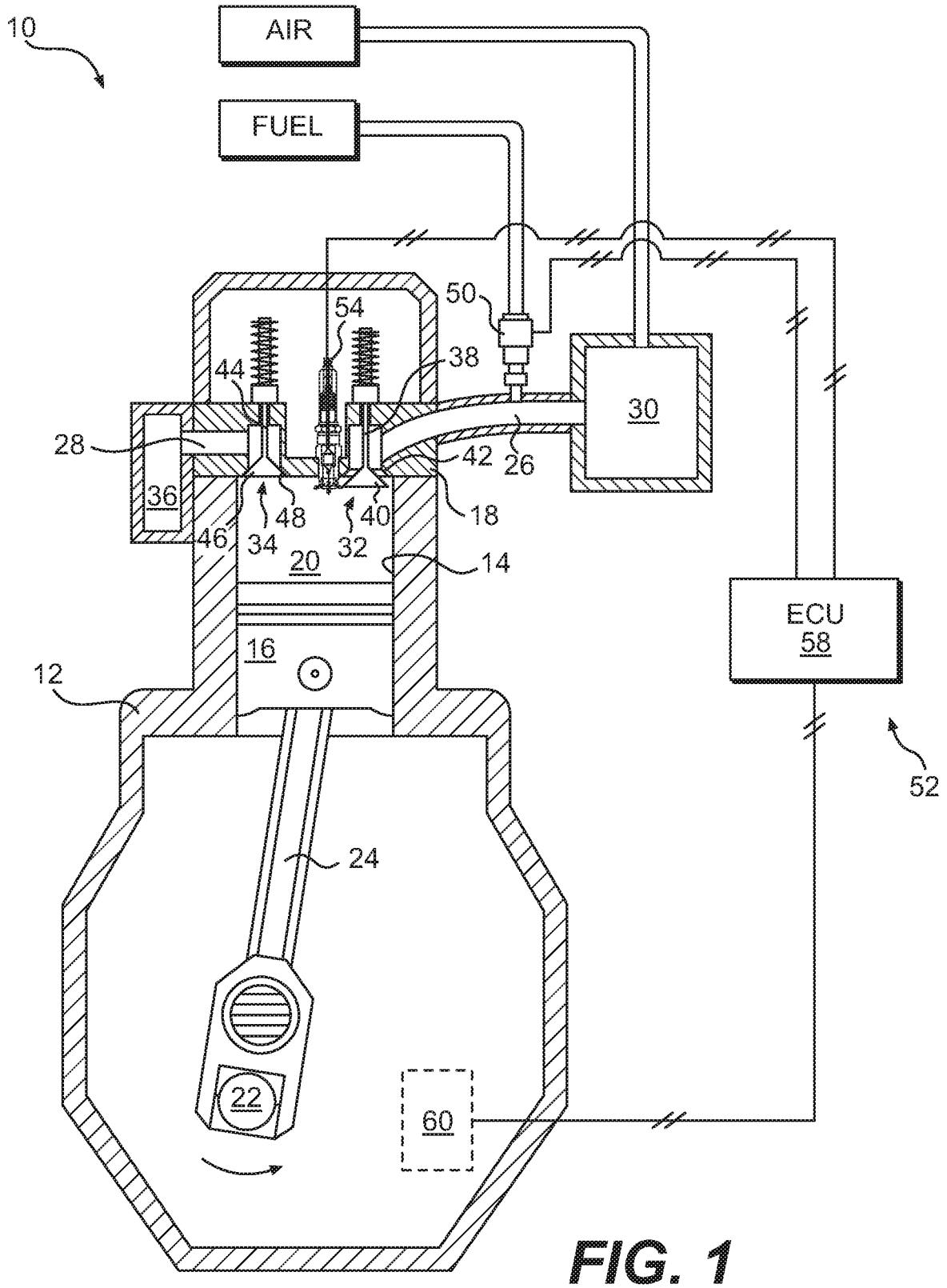
FIG. 1 is a diagrammatic and schematic illustration of an exemplary disclosed engine.

FIG. 1 illustrates an exemplary combustion engine 10. For the purposes of this disclosure, engine 10 is depicted and described as a four-stroke gaseous-fueled engine, for example a natural gas engine. One skilled in the art will recognize, however, that engine 10 may be any other type of combustion engine such as, for example, a gasoline or diesel-fueled engine. Engine 10 may include an engine block 12 that at least partially defines one or more cylinders 14 (only one shown in FIG. 1). A piston 16 may be slidably disposed within each cylinder 14 to reciprocate between a top-dead-center (TDC) position and a bottom-dead-center (BDC) position, and a cylinder head 18 may be associated with each cylinder 14. Cylinder 14, piston 16, and cylinder head 18 may together define a combustion chamber 20. It is contemplated that engine 10 may include any number of combustion chambers 20 and that combustion chambers 20 may be disposed in an "in-line" configuration, in a "V" configuration, or in any other suitable configuration.

Engine 10 may also include a crankshaft 22 that is rotatably disposed within engine block 12. A connecting rod 24 may connect each piston 16 to crankshaft 22 so that a sliding motion of piston 16 between the TDC and BDC positions within each respective cylinder 14 results in a rotation of crankshaft 22. Similarly, a rotation of crankshaft 22 may result in a sliding motion of piston 16 between the TDC and BDC positions. In a four-stroke engine, piston 16 may reciprocate between the TDC and BDC positions through an intake stroke, a compression stroke, a combustion or power stroke, and an exhaust stroke. It is also contemplated that engine 10 may alternatively be a two-stroke engine, wherein a complete cycle includes a compression/exhaust stroke (BDC to TDC) and a power/exhaust/intake stroke (TDC to BDC).

Cylinder head 18 may define an intake passageway 26 and an exhaust passageway 28. Intake passageway 26 may direct compressed air or an air and fuel mixture from an intake manifold 30, through an intake opening 32, and into combustion chamber 20. Exhaust passageway 28 may similarly direct exhaust gases from combustion chamber 20, through an exhaust opening 34, and into an exhaust manifold 36.

An intake valve 38 having a valve element 40 may be disposed within intake opening 32 and configured to selectively engage a seat 42. Valve element 40 may be movable between a first position, at which valve element 40 engages seat 42 to inhibit a flow of fluid relative to intake opening 32, and a second position, at which valve element 40 is removed from seat 42 to allow the flow of fluid.

An exhaust valve 44 having a valve element 46 may be similarly disposed within exhaust opening 34 and configured to selectively engage a seat 48. Valve element 46 may be movable between a first position, at which valve element 46 engages seat 48 to inhibit a flow of fluid relative to exhaust opening 34, and a second position, at which valve element 46 is removed from seat 48 to allow the flow of fluid.

A series of valve actuation assemblies (not shown) may be operatively associated with engine 10 to move valve elements 40 and 46 between the first and second positions. It should be noted that each cylinder head 18 could include multiple intake openings 32 and multiple exhaust openings 34. Each such opening would be associated with either an intake valve element 40 or an exhaust valve element 46. Engine 10 may include a valve actuation assembly for each cylinder head 18 that is configured to actuate all of the intake valves 38 or all of the exhaust valves 44 of that cylinder head 18. It is also contemplated that a single valve actuation assembly could actuate intake valves 38 or exhaust valves 44 associated with multiple cylinder heads 18, if desired. The valve actuation assemblies may embody, for example, a cam/push-rod/rocker arm arrangement, a solenoid actuator, a hydraulic actuator, or any other means for actuating known in the art.

A fuel injection device 50 may be associated with engine 10 to direct pressurized fuel into combustion chamber 20. Fuel injection device 50 may embody, for example, an electronic valve situated in communication with intake passageway 26. It is contemplated that injection device 50 could alternatively embody a hydraulically, mechanically, or pneumatically actuated injection device that selectively pressurizes and/or allows pressurized fuel to pass into combustion chamber 20 via intake passageway 26 or in another manner (e.g., directly). The fuel may include a compressed gaseous fuel such as, for example, natural gas, propane, bio-gas, landfill gas, or hydrogen. It is also contemplated that the fuel may be liquefied, for example, gasoline, diesel, methanol, ethanol, or any other liquid fuel, and that an onboard pump (not shown) may be required to pressurize the fuel.

The amount of fuel allowed into intake passageway 26 by injection device 50 may be associated with a ratio of fuel-to-air introduced into combustion chamber 20. Specifically, if it is desired to introduce a lean mixture of fuel and air (e.g., a mixture having a relatively low amount of fuel compared to the amount of air) into combustion chamber 20, injection device 50 may remain in an injecting position for a shorter period of time (or otherwise be controlled to inject less fuel per given cycle) than if a rich mixture of fuel and air (mixture having a relatively large amount of fuel compared to the amount of air) is desired. Likewise, if a rich mixture of fuel and air is desired, injection device 50 may remain in the injecting position for a longer period of time (or otherwise be controlled to inject more fuel per given cycle) than if a lean mixture is desired.

An ignition system 52 may be associated with engine 10 to help regulate the combustion of the fuel and air mixture within combustion chamber 20. Ignition system 52 may include an igniter 54 and an electronic control unit (ECU) 58. ECU 58 may be configured to regulate operation of igniter 54 in response to input received from one or more sensors 60.

Igniter 54 may facilitate ignition of the fuel and air mixture within combustion chamber 20. To initiate combustion of the fuel and air mixture, igniter 54 may be energized to locally heat the mixture, thereby creating a flame that propagates throughout combustion chamber 20. In one embodiment, igniter 54 is a spark plug. It is contemplated, however, that igniter 54 may alternatively embody a glow plug, an RF igniter, a laser igniter, or any other type of igniter known in the art.

ECU 58 may embody a single or multiple microprocessors, field programmable gate arrays (FPGAs), digital signal processors (DSPs), etc., that include a means for controlling an operation of engine 10 in response to signals received from sensor 60. Numerous commercially available microprocessors can be configured to perform the functions of ECU 58. It should be appreciated that ECU 58 could readily embody a general engine microprocessor capable of controlling numerous system functions and modes of operation. Various other known circuits may be associated with ECU 58, including power supply circuitry, signal-conditioning circuitry, actuator driver circuitry (i.e., circuitry powering solenoids, motors, or piezo actuators), communication circuitry, and other appropriate circuitry.

Sensor 60 may be configured to generate a signal indicative of operational information of engine 10. For example, sensor 60 may be disposed proximal to crankshaft 22, and configured to measure and generate a signal indicative of an instantaneous angular position of crankshaft 22. Based on this position, a speed of engine 10 may be derived and used to determine whether combustion is initiated. In another example, sensor 60 may be a temperature sensor configured to measure and generate a signal indicative of a temperature (e.g., an exhaust manifold gas temperature, and/or an inlet manifold air temperature) of engine 10 used to determine whether combustion is initiated. In yet another example, sensor 60 may be a boost gas pressure sensor configured to measure and generate a signal indicative of a gas pressure of engine 10 used to determine whether combustion is initiated.

Alternatively, sensor 60 may be an inlet manifold air pressure sensor configured to measure and generate a signal indicative of a gas pressure of engine 10 used to determine whether combustion is initiated. In some embodiments, sensor 60 may be an air-fuel ratio sensor configured to measure and generate a signal indicative of an air-fuel ratio of engine 10 used to determine whether combustion is initiated. In some embodiments, sensor 60 may be an electrical voltage sensor configured to measure and generate a signal indicative of breakdown voltage of a gas within a gap of igniter 54. The breakdown voltage may be used to determine whether combustion is initiated. Additionally, sensor 60 may be an electrical impedance (e.g., resistance) sensor configured to measure and generate a signal indicative of a gap resistance of the gap of igniter 54. The impedance may be used to determine whether combustion is initiated. It should be noted that other similar sensors are also contemplated.

In some embodiments, ECU 58 may include a memory, in which a striking profile library associated with igniter 54 can be stored. The striking profile library may include a plurality of different striking profiles. Each striking profile may correspond to a different operational information obtained by sensors 60. The plurality of different striking profiles differ in at least one of shape, magnitude, and duration. For example, each striking profile in the library may have a different electrical current waveform, for example a sine waveform, a square waveform, a triangle waveform, or a sawtooth waveform, also different magnitudes and/or durations. As described above, the operational information may include, but are not limited to, a methane number of supplied fuel, an air/fuel ratio, an inlet manifold air temperature, an inlet manifold air pressure, an engine speed, an exhaust manifold temperature, an engine load, etc.

Figure 2:
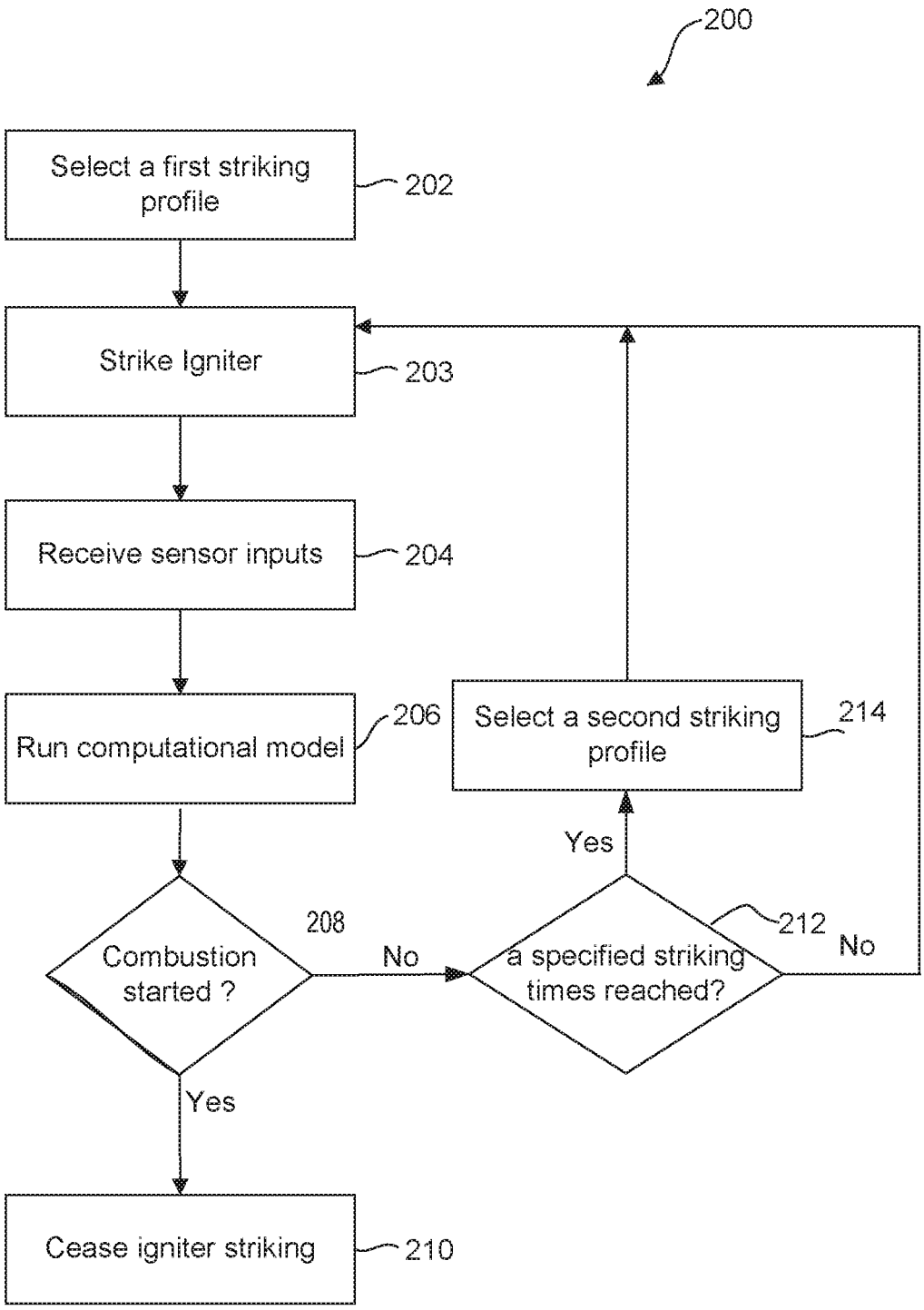
FIG. 2 is a flow chart illustrating an exemplary disclosed method that may be performed by the engine system of FIG. 1.

FIG. 2 is a flow chart 200 illustrating an exemplary disclosed method of controlling striking of igniter 54 that may be performed by the engine system of FIG. 1. FIG. 2 will be described in more detail below to further illustrate the concepts of this disclosure.

INDUSTRIAL APPLICABILITY

The disclosed ignition system may be applicable to any combustion engine, where extended igniter life is desired. The disclosed system may be particularly suited for an engine ignited by a spark plug. The disclosed ignition system may improve life and reliability of the spark plug, by eliminating unnecessary striking of the spark plug, and may also improve combustion initiation by dynamically adjusting striking. Operation of igniter 54 will now be explained with reference to FIG. 2.

During an intake stroke of engine 10, as piston 16 is moving within combustion chamber 20 between the TDC position and the BDC position, intake valve 38 may be in the first position, as shown in FIG. 1. During the intake stroke, the downward movement of piston 16 towards the BDC position may create a low-pressure condition within combustion chamber 20. The low-pressure condition may act to draw fuel and air from intake passageway 26 into combustion chamber 20 via intake opening 32. As described above, a turbocharger may alternatively be used to force compressed air and fuel into combustion chamber 20. The fuel may be introduced into the air stream either upstream or downstream of the turbocharger or, alternatively, may be injected directly into combustion chamber 20. It is contemplated that the fuel may alternatively or additionally be introduced into combustion chamber 20 during a portion of the compression stroke, if desired.

Following the intake stroke, both intake valve 38 and exhaust valve 44 may be in the second position at which the fuel and air mixture is blocked from exiting combustion chamber 20 during the ensuing upward compression stroke of piston 16. As piston 16 moves upward, from the BDC position towards the TDC position during the compression stroke, the fuel and air within combustion chamber 20 may be mixed and compressed. At a time during the compression stroke (e.g., at a particular crank angle before TDC) or, alternatively, just after completion of the compression stroke (e.g., at a particular crank angle after TDC) combustion of the compressed mixture may be initiated.

To initiate combustion of the compressed mixture, ECU 58 may select a first striking profile from the striking profile library stored in the memory (Step 202). The first striking profile may be selected based on the operational information of engine 10. The operational information may include, for example a methane number of supplied fuel, an air/fuel ratio, an inlet manifold air pressure, and/or an inlet manifold air temperature. For example, a higher methane number of supplied fuel detected by sensor 60 may indicate that a more powerful striking profile (e.g., a striking profile with a larger magnitude or with a different shape) is needed, because the larger the methane number, the higher the ignition temperature of the compressed mixture, accordingly the harder the compressed mixture is ignited. This operational information may be provided to ECU 58 at start-up of engine 10 (e.g., by sensors 60).

ECU 58 may then initiate a striking of igniter 54 by directing a current of the first striking profile to igniter 54 (Step 203). The striking of igniter 54 may locally heat the now compressed fuel and air mixture. This local heating may result in a flame that propagates throughout combustion chamber 20, thereby igniting the remaining fuel and air mixture.

ECU 58 may then receive various inputs from sensors 60 (Step 204). The various inputs may include, but are not limited to, a boost gas pressure if a turbocharger is utilized, an inlet manifold air pressure, an exhaust manifold temperature, an air-fuel ratio, an engine speed, a timing window, and/or any other information or operation parameters indicative of engine load. The air-fuel ratio may be measured based on an air flow rate and a fuel injection amount. The timing window may be indicative of a crank angle range before and after the TDC, during which striking of igniter 54 occurs. The timing window may also or alternatively be indicative of start and end of fuel injection, opening and/or closing of intake valve 38 and/or exhaust valve 44. The sensor inputs may further include torque information, as sensed by a sensor disposed on crankshaft 22.

Additionally, the sensor inputs may include a breakdown voltage of a gas within the gap of igniter 54. For example, if combustion of the compressed mixture has been ignited, the gas within the gap may change in, for example density and/or temperature, which may cause a change in the breakdown voltage of the gas. Further, the sensor inputs may also include a gap impedance of igniter 54 that may change with respect to the gas within the gap, for example, the electrical resistance of an unburned gas mixture is different from the electrical resistance of a burner gas mixture.

The sensor inputs may be received by a software program (e.g., a computational model) stored in a memory or a firmware of ECU 58. The software program may be downloaded to a storage of ECU 58 from an external source, and may embody as a computational model (e.g., an empirical model) including a suitable algorithm. Alternatively, functions of the software program may be partially implemented by hardware of ECU 58. After all the sensor inputs are received into the computational model, the computational model starts running and computing based on the sensor inputs for an output (Step 206). The output may be indicative of whether the combustion of the compressed mixture has been started by the striking of igniter 54 (Step 208). The output may be presented using equations, maps, graphs, etc.

If the output indicates that igniter 54 has successfully initiated combustion of the compressed mixture, ECU 58 may control and cease further striking of igniter 54 (Step 210). In contrast to conventional operation of igniter 54, termination of subsequent restriking of igniter 54 may effectively improve the life of igniter 54 by reducing unnecessary striking, that is, by reducing amount of energy and/or duration of energy passing through igniter 54.

If the output from the computational model indicates that the combustion of the compressed mixture has not successfully started (i.e., NO in Step 208), subsequent restriking of igniter 54 may be needed. In these situations, the restriking of igniter 54 may be performed using a same striking profile (i.e., the first striking profile) for a specified number of times, if necessary (i.e., as long as the combustion of the compressed mixture has not successfully started by an immediate prior striking of igniter 54). Prior to each restriking of igniter 54, ECU 58 may determine whether the specified striking times are reached (Step 212). If the specified striking times have not yet been reached, the restriking of igniter 54 will be performed using the first striking profile. Then steps of 203-212 may be repeated.

If the specified striking times are determined to be reached in Step 212, ECU 58 may select a second striking profile from the striking profile library (Step 214). ECU 58 may then direct a corresponding current according to the second striking profile to igniter 54 to perform the restriking (Step 203). Then steps of 203-214 may be repeated.

Several advantages may be associated with the disclosed ignition system. First, by incorporating various sensor inputs into a software program for detecting combustion initiation, unnecessary striking and/or restriking of a spark plug may be eliminated to improve the spark plug life because the spark plug life is inversely proportional to the number of striking times. Second, energy waste is reduced thereby decreasing operational cost and improving performance of engine 10. Third, no extra hardware may be required to employ the disclosed ignition system, because existing ignition circuitry and engine sensors may work well with the disclosed ignition system.

It will be apparent to those skilled in the art that various modifications and variations can be made to the disclosed ignition system. Other embodiments will be apparent to those skilled in the art from consideration of the specification and practice of the disclosed ignition system. It is intended that the specification and examples be considered as exemplary only, with a true scope being indicated by the following claims and their equivalents.

What is claimed is:

1. An ignition system for an engine, the ignition system comprising:

an igniter connected to selectively ignite a fuel-oxidizer mixture within the engine;

at least one sensor configured to sense operational information of the engine and generate corresponding signals; and a controller in communication with the igniter and the at least one sensor, and including a striking profile library stored in a memory, the controller being configured to:

retrieve a first striking profile from the striking profile library based on the operational information;

cause a first striking of the igniter using the first striking profile to ignite the fuel-oxidizer mixture;

make an ignition determination whether the fuel-oxidizer mixture has been ignited by the igniter based on the signals; and in response to the ignition determination indicating that combustion of the fuel-oxidizer mixture has not been initiated:

retrieve a second striking profile from the striking profile library in response to the ignition determination, the second striking profile being different from the first striking profile;

count a number of strikings using the first striking profile for which combustion of the fuel-oxidizer mixture has not been initiated; and cause a second striking of the igniter using the second striking profile in response to the number of strikings exceeding a specified number of strikings without combustion initiation.

2. The ignition system of claim 1, wherein the controller further includes a computational model stored in a memory, the computational model being configured to make the ignition determination based on the operational information.

3. The ignition system of claim 1, wherein the striking profile library includes a plurality of striking profiles, each striking profile of the plurality of striking profiles being different from all other striking profiles of the plurality of striking profiles, each striking profile corresponding to a different value of the operational information.

4. The ignition system of claim 3, wherein each striking profile differs from all other striking profiles in at least one of a shape, a magnitude, and a duration.

5. The ignition system of claim 1, wherein the operational information of the engine includes at least one of a boost gas pressure, an inlet manifold air pressure, an exhaust manifold gas temperature, an air-fuel ratio, an engine speed, a torque, an inlet manifold air temperature, a breakdown voltage, and a gap impedance.

6. A method for initiating combustion within an engine, the method comprising:

retrieving a first striking profile from a striking profile library;

initiating a first striking of an igniter using the first striking profile to ignite a fuel-oxidizer mixture within the engine;

receiving a signal from a sensor that senses operational information of the engine;

determining whether the fuel-oxidizer mixture within the engine has been ignited by the igniter based at least in part on the signal; and in response to a determination that combustion of the fuel-oxidizer mixture has not been initiated:

retrieving a second striking profile from the striking profile library, the second striking profile being different from the first striking profile;

counting a number of strikings using the first striking profile for which combustion of the fuel-oxidizer mixture has not been initiated; and initiating a second striking of the igniter using the second striking profile in response to the number of strikings exceeding a specified number of strikings without combustion initiation.

7. The method of claim 6, wherein an electric current profile of the first striking profile is different from an electric current profile of the second striking profile.

8. The method of claim 7, wherein the electric current profile of the first striking profile and the electric current profile of the second striking profile are retrieved from the striking profile library stored in a memory.

9. The method of claim 6, wherein the striking profile library includes a plurality of striking profiles, each striking profile of the plurality of striking profiles being different all other striking profiles of the plurality of striking profiles, each striking profile corresponding to a different operational information.

10. The method of claim 9, wherein each striking profile differs from all other striking profiles in at least one of a shape, a magnitude, and a duration.

11. The method of claim 6, wherein determining whether the fuel-oxidizer mixture is ignited is performed by a computational model based on the operational information.

12. The method of claim 11, wherein the operational information of the engine includes at least one of a boost gas pressure, an inlet manifold air pressure, an exhaust manifold gas temperature, an air-fuel ratio, an engine speed, a torque, an inlet manifold air temperature, a breakdown voltage, and a gap impedance.

13. An engine, comprising:

an engine block at least partially defining a cylinder;

a piston reciprocatingly disposed within the cylinder to form a combustion chamber;

an igniter located to locally heat a fuel-oxidizer mixture within the combustion chamber;

at least one sensor configured to sense operational information of the engine and generate corresponding signals; and a controller in communication with the igniter and the at least one sensor, and including a striking profile library stored in a memory, the controller being configured to:

cause a first striking of the igniter to ignite the fuel-oxidizer mixture according to a first striking profile retrieved from the striking profile library;

make an ignition determination whether the fuel-oxidizer mixture has been ignited by the igniter based on the signals; and in response to the ignition determination indicating that combustion of the fuel-oxidizer mixture has not been initiated:

retrieve a second striking profile from the striking profile library, the second striking profile being different from the first striking profile;

count a number of strikings using the first striking profile for which combustion of the fuel-oxidizer mixture has not been initiated; and cause a second striking of the igniter using the second striking profile in response to the number of strikings exceeding a specified number of strikings without combustion initiation.

14. The engine of claim 13, wherein the operational information of the engine includes at least one of a boost gas pressure, an inlet manifold air pressure, an exhaust manifold gas temperature, an air-fuel ratio, an engine speed, a torque, an inlet manifold air temperature, a breakdown voltage, and a gap impedance.

15. The engine of claim 13, wherein the controller further includes a computational model stored in the memory, the computational model being configured to make the ignition determination based on the operational information.

16. The ignition system of claim 3, wherein a duration of each striking profile differs from durations of all other striking profiles.

17. The method of claim 9, wherein a duration of each striking profile differs from durations of all other striking profiles.

* * * * *